US007997705B2

(12) United States Patent
Takagi

(10) Patent No.: US 7,997,705 B2
(45) Date of Patent: Aug. 16, 2011

(54) INK CARTRIDGES AND INK SUPPLY SYSTEMS

(75) Inventor: Yuki Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 466 days.

(21) Appl. No.: 12/326,078

(22) Filed: Dec. 1, 2008

(65) Prior Publication Data

US 2009/0141106 A1 Jun. 4, 2009

(30) Foreign Application Priority Data

Dec. 1, 2007 (JP) ..... 2007-311821

(51) Int. Cl.
*B41J 2/175* (2006.01)

(52) U.S. Cl. ..... 347/86; 347/85

(58) Field of Classification Search ..... 347/84, 347/85, 86

See application file for complete search history.

(56) References Cited

U.S. PATENT DOCUMENTS 7,562,972 B2 * 7/2009 Hattori et al. ..... 347/86
2007/0070147 A1 3/2007 Hattori et al.

FOREIGN PATENT DOCUMENTS

JP 2007-144808 A 6/2007

* cited by examiner

*Primary Examiner* — Huan H Tran
(74) *Attorney, Agent, or Firm* — Baker Botts L.L.P.

(57) ABSTRACT

An ink cartridge includes a case having an ink chamber and a wall, an air communication portion having a first opening, and an ink supply portion having a second opening. The air communication portion includes a first lid member that moves between a first position not covering the first opening, and a second position covering the first opening, and a first biasing member that applies a first biasing force to the first lid member. The ink supply portion includes a second lid member that moves between a third position not covering the second opening and a fourth position covering the second opening, and a second biasing member that applies a second biasing force to the second lid member. When the first lid member is in the second position and the second lid member is in the fourth position, the first biasing force is less than the second biasing force.

12 Claims, 8 Drawing Sheets

INK CARTRIDGES AND INK SUPPLY SYSTEMS

CROSS-REFERENCE TO RELATED APPLICATION

The present application claims priority from Japanese Patent Application No. JP-2007-311821, which was filed on Dec. 1, 2007, the disclosure of which is incorporated herein by reference in its entirety.

BACKGROUND OF THE INVENTION

1. Field of the Invention

The invention relates to ink cartridges and ink supply systems.

2. Description of Related Art

A known ink-jet image recording apparatus has a recording head and an ink supply system configured to supply ink to the recording head. The known ink supply system has a known cartridge mounting portion, and a known ink cartridge is configured to be mounted to the cartridge mounting portion. The known ink cartridge has a case, and the case has an ink chamber formed therein. The ink chamber is configured to store ink therein. The known ink cartridge has an ink supply portion, and ink is supplied from an interior of the ink chamber to an exterior of the ink chamber via the ink supply portion.

The known ink cartridge also has an air communication portion, and air is introduced into the interior of the ink chamber via the air communication portion. When the known ink cartridge is mounted to the ink supply device, ink stored in the ink chamber is supplied to the recording head via the ink supply portion while air is introduced into the interior of the ink chamber via the air communication portion. The recording head is configured to selectively eject ink toward a sheet of paper, such that an image is recorded on the sheet.

Another known ink cartridge, e.g., the ink cartridge described in JP-A-2007-144808, has a case, and an ink supply portion and an air communication portion positioned at a side face of the case. The ink supply portion has a supply valve configured to cover and uncover an ink supply opening formed through the ink supply portion. The supply valve is resiliently biased toward the ink supply opening by a resilient member made of resin. Therefore, when the ink cartridge is not mounted to a cartridge mounting portion, the ink supply opening is covered by the supply valve. When the ink cartridge is mounted to the cartridge mounting portion, an ink tube of the cartridge mounting portion is inserted into the ink supply opening. The supply valve moves away from the ink supply opening while receiving a pressing force from the ink tube. Ink is supplied from the interior of the ink chamber to the recording head via the ink tube inserted into the ink supply opening. The air communication portion has an air valve configured to cover and uncover an air communication opening formed through the air communication portion. The air valve is resiliently biased toward the air communication opening by a resilient member made of resin.

In the known ink cartridge, when the ink cartridge is not mounted to the cartridge mounting portion, the air communication opening is covered by the air valve. When the ink cartridge is mounted to the cartridge mounting portion, the air valve receives a pressing force from the cartridge mounting portion, and the valve moves away from air communication opening. Consequently, air flows into the interior of the ink chamber through the air communication opening, and ink is supplied via the ink supply portion smoothly.

The supply valve and the air valve receive a first biasing force and a second biasing force from the resilient members, respectively. The first biasing force is equal to the second biasing force. Therefore, when the ink cartridge is mounted to the cartridge mounting portion, the side face of the case extends in the gravitational direction, such that the ink supply opening is positioned at the lowermost position with respect to the surface of ink stored in the ink chamber, and hence ink may leak via the ink supply opening.

When the first biasing force and the second biasing force are set to be relatively weak, a user may easily mount the ink cartridge to the cartridge mounting portion because a force which the user receives from the resilient members are relatively weak. Nevertheless, ink may leak from the ink supply opening because the supply valve may not cover the ink supply opening reliably. In contrast, when the first biasing force and the second biasing force are set to be relatively strong, the supply valve may cover the ink supply opening reliably. Nevertheless, the user may have a difficulty in mounting the ink cartridge to the cartridge mounting portion because the user receives a relatively strong force from the resilient members. If different resilient members are used for biasing the supply valve and biasing the air valve, an operator may improperly install the incorrect resilient members when the ink cartridge is manufactured. The assembly work of the ink cartridge may become complicated.

SUMMARY OF THE INVENTION

Therefore, a need has arisen for ink cartridges and ink supply systems which overcome these and other shortcomings of the related art. A technical advantage of the invention is that ink leakage is suppressed. Another technical advantage of the invention is that an ink cartridge is easily mounted to a cartridge mounting portion.

According to an embodiment of the invention, an ink cartridge comprises a case comprising an ink chamber configured to store ink therein and a particular wall. The ink cartridge also comprises an air communication portion positioned at the particular wall and having a first opening formed therethrough, wherein the air communication portion is configured to place an interior of the ink chamber and an exterior of the ink chamber in fluid communication via the first opening. The air communication portion comprises a first lid member configured to move between a first position and a second position, wherein when the first lid member is in the first position, the first lid member does not cover the first opening and when the first lid member is in the second position, the first lid member covers the first opening, and a first biasing member configured to apply a first biasing force to the first lid member toward the first opening. The ink cartridge also comprises an ink supply portion positioned at the particular wall and having a second opening formed therethrough, wherein the ink supply portion is configured to supply ink from the interior of the ink chamber to the exterior of the ink chamber via the second opening. The ink supply portion comprises a second lid member configured to move between a third position and a fourth position, wherein when the second lid member is in the third position, the second lid member does not cover the second opening and when the second lid member is in the fourth position, the second lid member covers the second opening, and a second biasing member configured to apply a second biasing force to the second lid member toward the second opening, wherein when the first lid member is in the second position and the second lid member is in the fourth position, the first biasing force is less than the second biasing force.

According to another embodiment of the invention, an ink supply system comprises a cartridge mounting portion, and an ink cartridge configured to be mounted to the cartridge mounting portion. The ink cartridge comprises a case comprising an ink chamber configured to store ink therein and a particular wall. The ink cartridge also comprises an air communication portion positioned at the particular wall and having a first opening formed therethrough, wherein the air communication portion is configured to place an interior of the ink chamber and an exterior of the ink chamber in fluid communication via the first opening. The air communication portion comprises a first lid member configured to move between a first position and a second position, wherein when the first lid member is in the first position, the first lid member does not cover the first opening and when the first lid member is in the second position, the first lid member covers the first opening; and a first biasing member configured to apply a first biasing force to the first lid member toward the first opening. The ink cartridge also comprises an ink supply portion positioned at the particular wall and having a second opening formed therethrough, wherein the ink supply portion is configured to supply ink from the interior of the ink chamber to the exterior of the ink chamber via the second opening. The ink supply portion comprises a second lid member configured to move between a third position and a fourth position, wherein when the second lid member is in the third position, the second lid member does not cover the second opening and when the second lid member is in the fourth position, the second lid member covers the second opening, and a second biasing member configured to apply a second biasing force to the second lid member toward the second opening. When the ink cartridge is mounted to the cartridge mounting portion, the ink supply portion is positioned below the air communication portion, the first lid member is in the first position, the second lid member is in the third position, and the first biasing force is greater than the second biasing force.

According to yet another embodiment of the invention, an ink supply system comprises a cartridge mounting portion and an ink cartridge configured to be mounted to the cartridge mounting portion. The ink cartridge comprises a case comprising an ink chamber configured to store ink therein, and a particular wall. The ink cartridge also comprises an air communication portion positioned at the particular wall and having a first opening formed therethrough, wherein the air communication portion is configured to place an interior of the ink chamber and an exterior of the ink chamber in fluid communication via the first opening. The air communication portion comprises a first lid member configured to move between a first position and a second position, wherein when the first lid member is in the first position, the first lid member does not cover the first opening and when the first lid member is in the second position, the first lid member covers the first opening, a rod extending from the first lid member through the first opening, and a first biasing member comprising a first compression spring, the first compression spring comprising a first end and a second end opposite the first end, wherein the first biasing member is configured to expand in a particular direction and contract in a direction opposite to the particular direction, and to apply a first biasing force to the first lid member toward the first opening. The ink cartridge further comprises an ink supply portion positioned at the particular wall and having a second opening formed therethrough, wherein the ink supply portion is configured to supply ink from the interior of the ink chamber to the exterior of the ink chamber via the second opening. The ink supply portion comprises a second lid member configured to move between a third position and a fourth position, wherein when the second lid member is in the third position, the second lid member does not cover the second opening and when the second lid member is in the fourth position, the second lid member covers the second opening, and a second biasing member comprising a second compression spring, the second biasing member comprising a first end and a second end opposite the first end, wherein the first biasing member is configured to expand in the particular direction and contract in a direction opposite to the particular direction, and to apply a second biasing force to the second lid member toward the second opening. The first compression spring and the second compression spring are substantially identical, and wherein when the first lid member is in the second position and the second lid member is in the fourth position, a distance between the first end of the second biasing member and the second end of the second biasing member is less than a distance between the first end of the first biasing member and the second end of the first biasing member in a particular direction, wherein during a mounting of the ink cartridge to the cartridge mounting portion, the air communication portion and the ink supply portion are configured such that the first lid member starts to move from the second position toward the first position before the second lid member starts to move from the fourth position toward the third position, wherein the first lid member is configured to move from the second position to the first position by the rod being pressed against the cartridge mounting portion, and wherein when the ink cartridge is mounted to the cartridge mounting portion, the ink supply portion is positioned below the air communication portion, the first lid member is in the first position, the second lid member is in the third position, and the first biasing force is greater than the second biasing force.

Other objects, features, and advantages of embodiments of the invention will be apparent to persons of ordinary skill in the art from the following description of embodiments with reference to the accompanying drawings.

BRIEF DESCRIPTION OF DRAWINGS

For a more complete understanding of the invention, the needs satisfied thereby, and the objects, features, and advantages thereof, reference now is made to the following description taken in connection with the accompanying drawings.

DETAILED DESCRIPTION OF EMBODIMENTS

Embodiments of the invention and their features and technical advantages may be understood by referring to FIGS. 1 to 8, like numerals being used for like corresponding portions in the various drawings.

Figure 2:
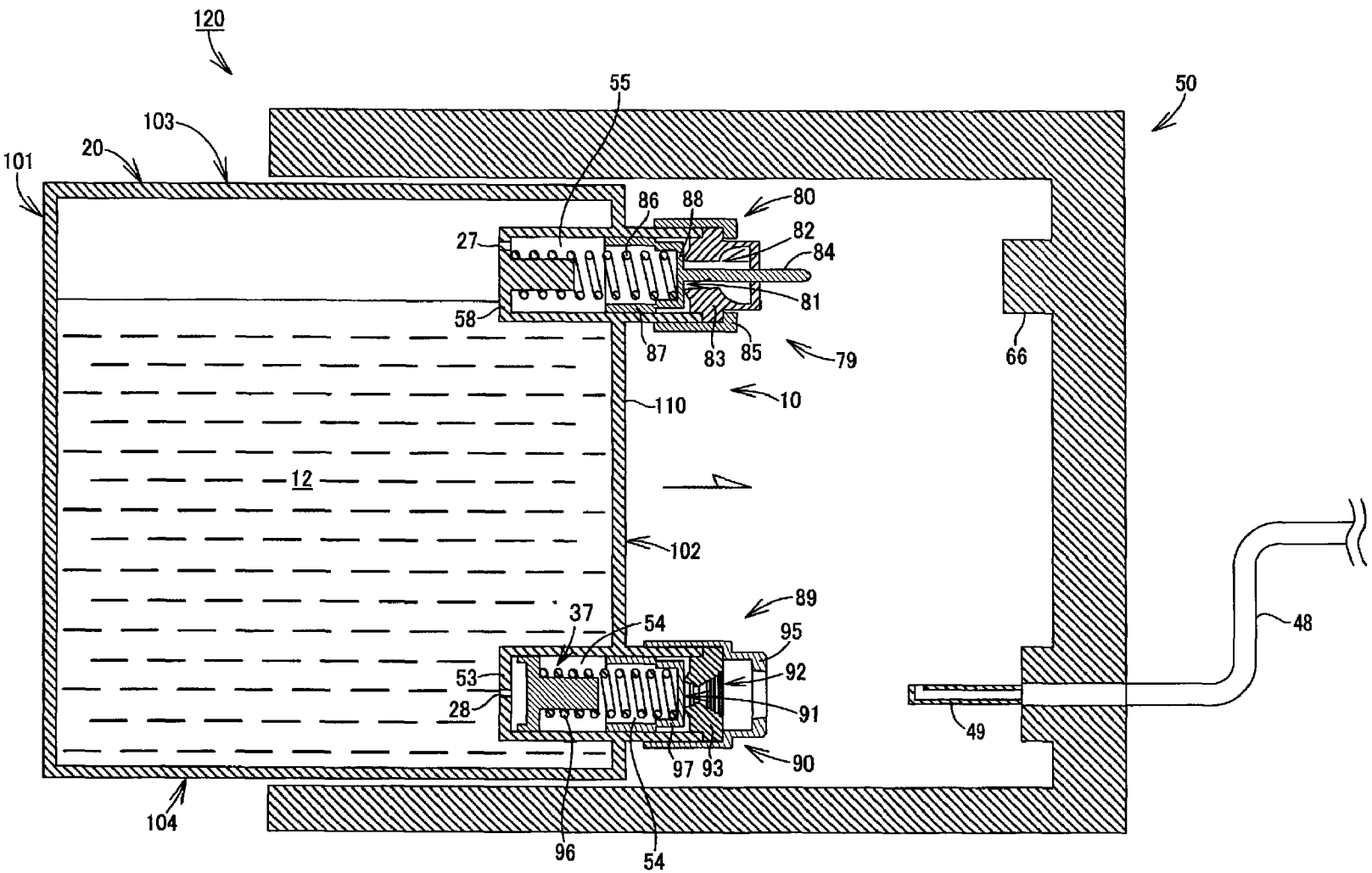
FIG. 2 is a cross-sectional view of the ink cartridge of FIGS. 1(A) and 1(B) and a cartridge mounting portion according to an embodiment of the invention, in which an ink introduction portion of the ink cartridge is omitted.

FIG. 2 shows an ink supply system 120 according to an embodiment of the invention. Ink supply system 120 may be used in an ink-jet printer (not shown). Ink supply system 120 may be configured to supply ink to a recording head (not shown) of the ink-jet printer. Ink supply system 120 may comprise at least one cartridge mounting portion 50, at least one ink cartridge 10, and at least one flexible ink tube 48. In an embodiment, four ink cartridges 10 may be removably mounted to four cartridge mounting portions 50, respectively. Four ink cartridges 10 may store ink, e.g., black, yellow, cyan, and magenta inks, respectively. Ink cartridge 10 may comprise a case 20 comprising an ink chamber 12 configured to store ink therein. When ink cartridge 10 is mounted to cartridge mounting portion 50, ink stored in ink chamber 12 may be supplied to the recording head via flexible ink tube 48.

Figure 1B:
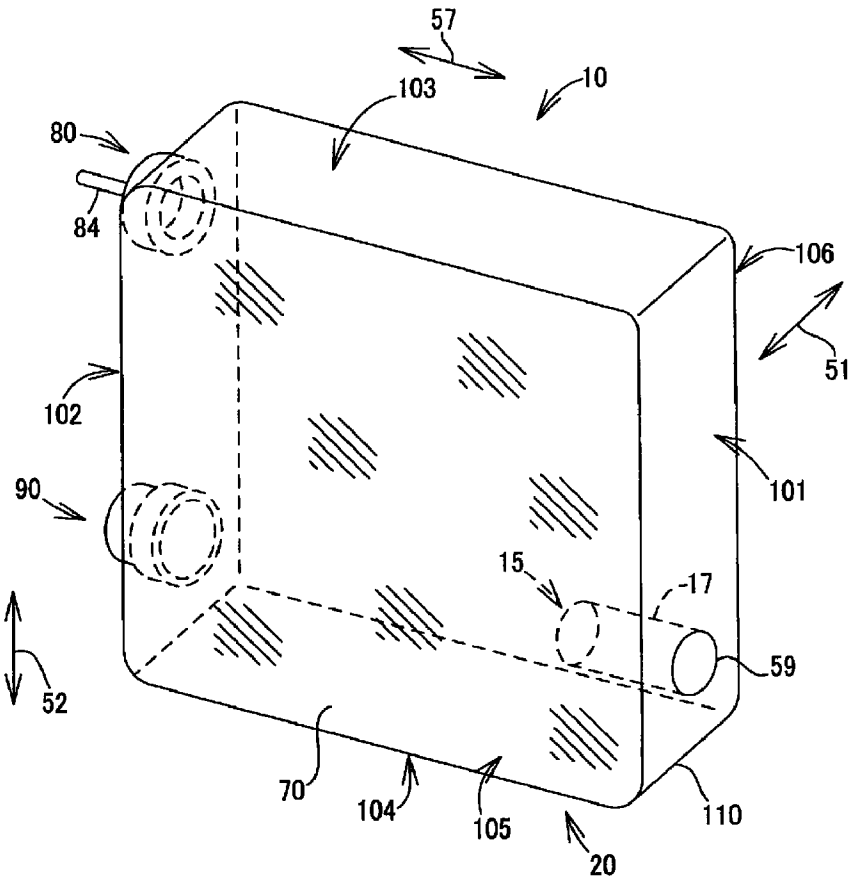
FIG. 1(B) is a rear perspective view of the ink cartridge according to an embodiment of the invention.
Figure 1A:
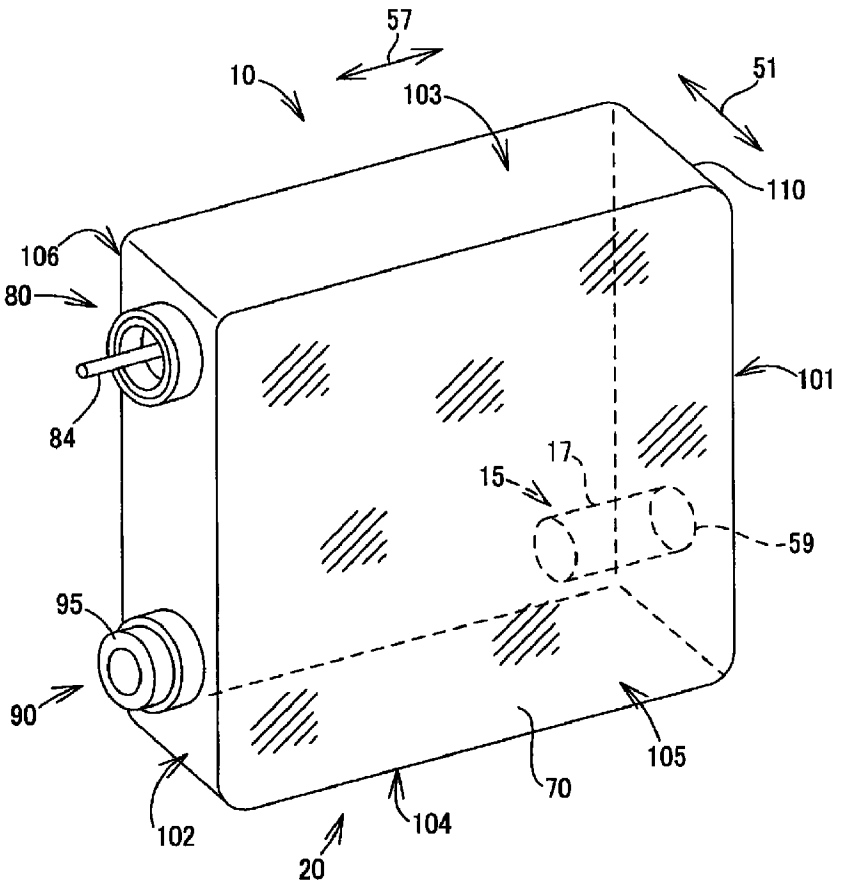
FIG. 1(A) is a front perspective view of an ink cartridge according to an embodiment of the invention.

Referring to FIG. 1, ink cartridge 10 may have a flattened, substantially rectangular parallelepiped shape having a width in a width direction 51, a height in a height direction 52, and a depth in a depth direction 57. The width of ink cartridge 10 may be less than the height of ink cartridge 10 and less than the depth of ink cartridge 10.

Ink cartridge 10 may comprise case 20, an air communication valve mechanism 80, and an ink supply valve mechanism 90. Each of case 20, air communication valve mechanism 80, and ink supply valve mechanism 90 may comprise a resin material e.g., nylon, polyethylene, polypropylene, or combination thereof. Ink cartridge 10 may comprise an outer case (not shown) covering substantially the entirety of case 20. Ink cartridge 10 also may comprise a protector (not shown) which may cover air communication valve mechanism 80 and ink supply valve mechanism 90.

Case 20 may comprise a front wall 102, a rear wall 101 positioned opposite front wall 102, a top wall 103 extending between front wall 102 and rear wall 101, a bottom wall 104 extending between front wall 102 and rear wall 101 and positioned opposite top wall 103, a left wall 105 extending between front wall 102 and rear wall 101, and a right wall 106 extending between front wall 102 and rear wall 101 and positioned opposite left wall 105. Each of front wall 102, rear wall 101, top wall 103, bottom wall 104, left wall 105, and right wall 106 may face the exterior of case 20, and define the outer appearance of case 20. When cartridge 10 is inserted into cartridge mounting portion 50, case 20 may be inserted from a front wall 102 side.

When ink cartridge 10 is mounted to cartridge mounting portion 50, top wall 103 is positioned at the top of case 20 and bottom wall 104 is positioned at the bottom of case 20. Each of an area of left wall 105 and an area of right wall 106 may be greater than each of an area of front wall 102, an area of rear wall 101, an area of top wall 103, and an area of bottom wall 104.

Case 20 may comprise a frame 110 and a pair of films 70. Frame 110 may comprise front wall 102, rear wall 101, top wall 103, and bottom wall 104. Pair of films 70 may comprise left wall 105 and right wall 106. Frame 110 may comprise a translucent resin material, e.g., a transparent or semi-transparent resin material, e.g., polyacetal, nylon, polyethylene, polypropylene, or the like, and may be manufactured by injection molding the resin material. Frame 110 may have a substantially rectangular profile extending along front wall 102, top wall 103, rear wall 101, and bottom wall 104, forming a space inside. A pair of openings may be formed at widthwise ends of the frame 110, respectively.

In an embodiment of the invention, pair of films 70 may be attached, e.g., welded or bonded with adhesive, to the widthwise ends of frame 110, such that each opening may be covered by one of pair of films 70. Frame 110 and pair of films 70 may define an ink chamber 12 therein. Ink chamber 12 may be configured to store ink therein. In another embodiment, a frame may be a container having six rigid walls, and an ink chamber may be formed in the container.

Frame 110 may comprise an ink introduction portion 15 positioned at rear face 101. Ink introduction portion 15 may comprise a substantially circular, cylindrical chamber 17 extending from an opening 59 formed through rear surface 101 toward ink chamber 12. Cylindrical chamber 17 may be configured to be in fluid communication with ink chamber 12. When ink cartridge 10 is manufactured, ink may be introduced into ink chamber 12 via ink introduction portion 15, such that ink chamber 12 is filled with ink.

Figure 3:
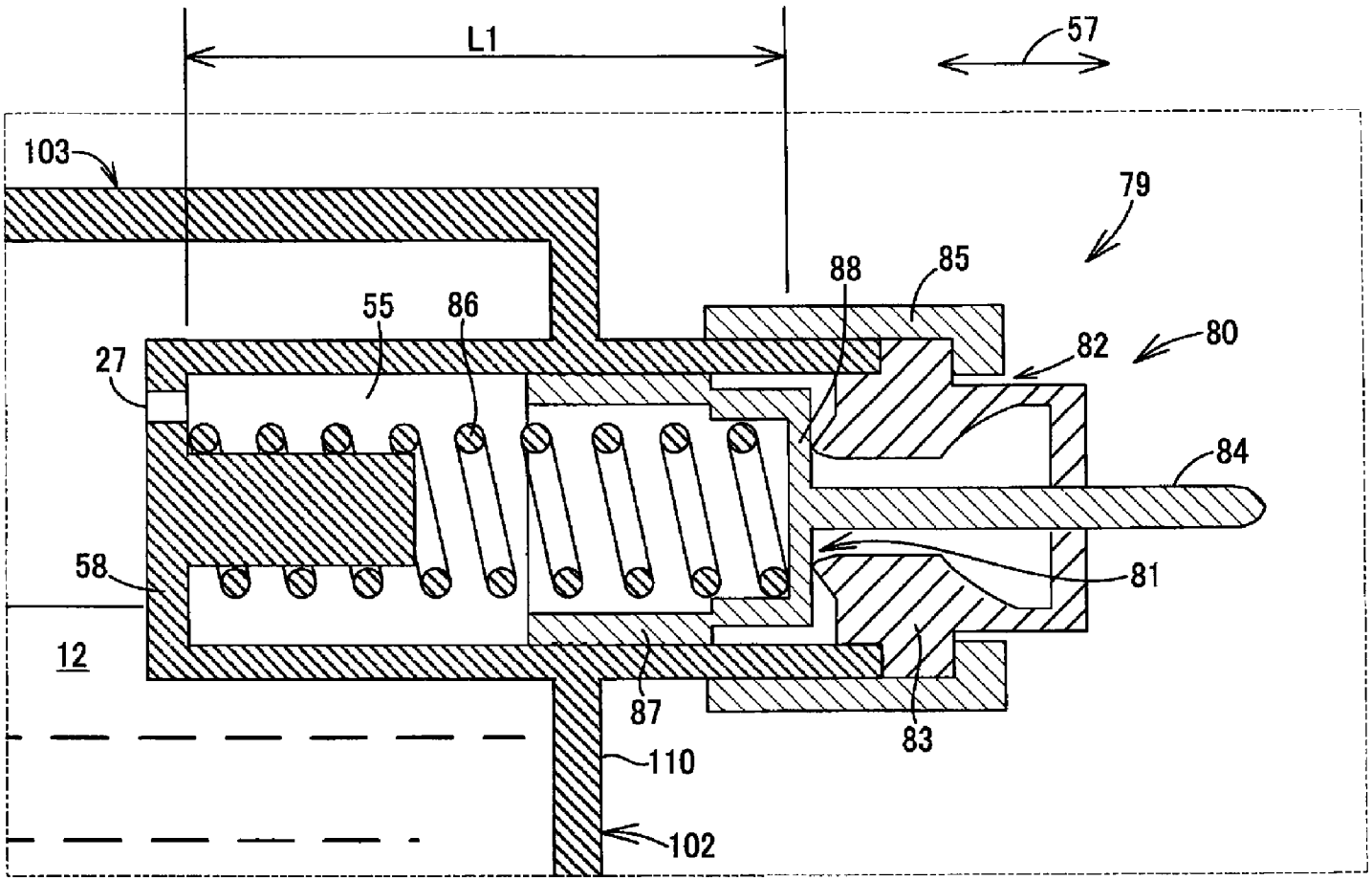
FIG. 3 is an enlarged cross-sectional view of an air communication portion according to an embodiment of the invention.

Referring to FIG. 3, ink cartridge 10 may comprise an air communication portion 79 positioned at front wall 102. Air communication portion 79 may comprise a circular, cylindrical wall extending from a portion of front wall 102 toward the exterior of case 20 in depth direction 57. The portion of front wall 102 from which the cylindrical wall of air communication portion 79 extends may be positioned adjacent to top wall 103. A circular opening 82 may be formed at an end of the cylindrical wall. A valve chamber 55 may be formed in the cylindrical wall, and valve chamber 55 may extend from opening 82 in depth direction 57, via the interior of the cylindrical wall to the interior of case 20 beyond front wall 102. Valve chamber 55 may extend in depth direction 57. Frame 110 may comprise an end wall 58 defining an end of valve chamber 55 opposite opening 82, and valve chamber 55 may be configured to be in fluid communication with ink chamber 12 via an opening 27 formed through end wall 58. Air communication portion 79 also may comprise air communication valve mechanism 80, and at least a portion of air communication valve mechanism 80 may be accommodated in valve chamber 55.

Air communication valve mechanism 80 may be configured to selectively allow and prevent fluid communication between the interior of ink chamber 12 and the exterior of case 20 via opening 82 and valve chamber 55. Air communication valve mechanism 80 may comprise a compression coil spring 86, a valve member 87, a sealing member 83, and a cap 85. Valve element 87 may be positioned in valve chamber 55, and configured to slide in depth direction 57. Valve element 87 may comprise a first lid member 88 and a rod 84 extending from first lid member 88.

Sealing member 83 may be positioned at the end of the cylindrical wall defining opening 82. Cap 85 may be attached to the outer peripheral portion of the cylindrical wall, and sealing member 83 may be positioned therebetween. Cap 85 and sealing member 83 may have openings formed therethrough in depth direction 57, respectively. The openings of cap 85 and sealing member 83 may form an air communication opening 81, and valve chamber 55 may be configured to be in fluid communication with the exterior of case 20 via air communication opening 81.

Rod 84 may be inserted into the air communication opening 81. A diameter of rod 84 may be less than a diameter of air communication opening 81, such that rod 84 may move with respect to sealing member 83 without contacting sealing member 83. A gap may be formed between rod 84 and sealing member 83 at air communication opening 81, and air may pass through the gap. Rod 84 may extend through the center of opening 82 to the exterior of case 20 along a central axis of first lid member 88.

When valve element 87 slides in valve chamber 55 in depth direction 57, first lid member 88 may move between a first position in which first lid member 88 is positioned away from sealing member 83 and in which first lid member uncovers, e.g., does not cover, air communication opening 81, and a second position in which first lid member 88 contacts sealing member 83 and covers air communication opening 81. When first lid member 88 is in the second position, a path extending from valve chamber 55 via the gap to the exterior of case 20 may be blocked. When first lid member 88 is in the first position, the path may be opened.

Compression coil spring 86 may be positioned in valve chamber 55, and may be configured to expand and contract in depth direction 57. Compression coil spring 86 may contact and apply a biasing force to first lid member 88 toward opening 81 in depth direction 57. Therefore, when no external force is applied to first lid member 88 in depth direction 57, first lid member 88 may be in the second position. Referring to FIGS. 5 to 8, when ink cartridge 10 is mounted to cartridge mounting portion 50, rod 84 may be pressed against a pressing portion 66 of cartridge mounting portion 50, and pressing portion 66 may apply a pressing force to first lid member 88 via rod 84 toward end wall 58. When first lid member 88 receives the pressing force from pressing portion 66 via rod 84, first lid member 88 may move away from sealing member 83 against the biasing force of compression coil spring 86.

When first lid member 88 moves away from sealing member 83, air communication opening 81 may be uncovered, and a path extending from the interior of ink chamber 12 to the exterior of case 20 may be opened. Air may pass though the path extending from the interior of ink chamber 12 to the exterior of case 20, such that the pressure in ink chamber 12 may become equal to the atmospheric pressure.

Figure 4:
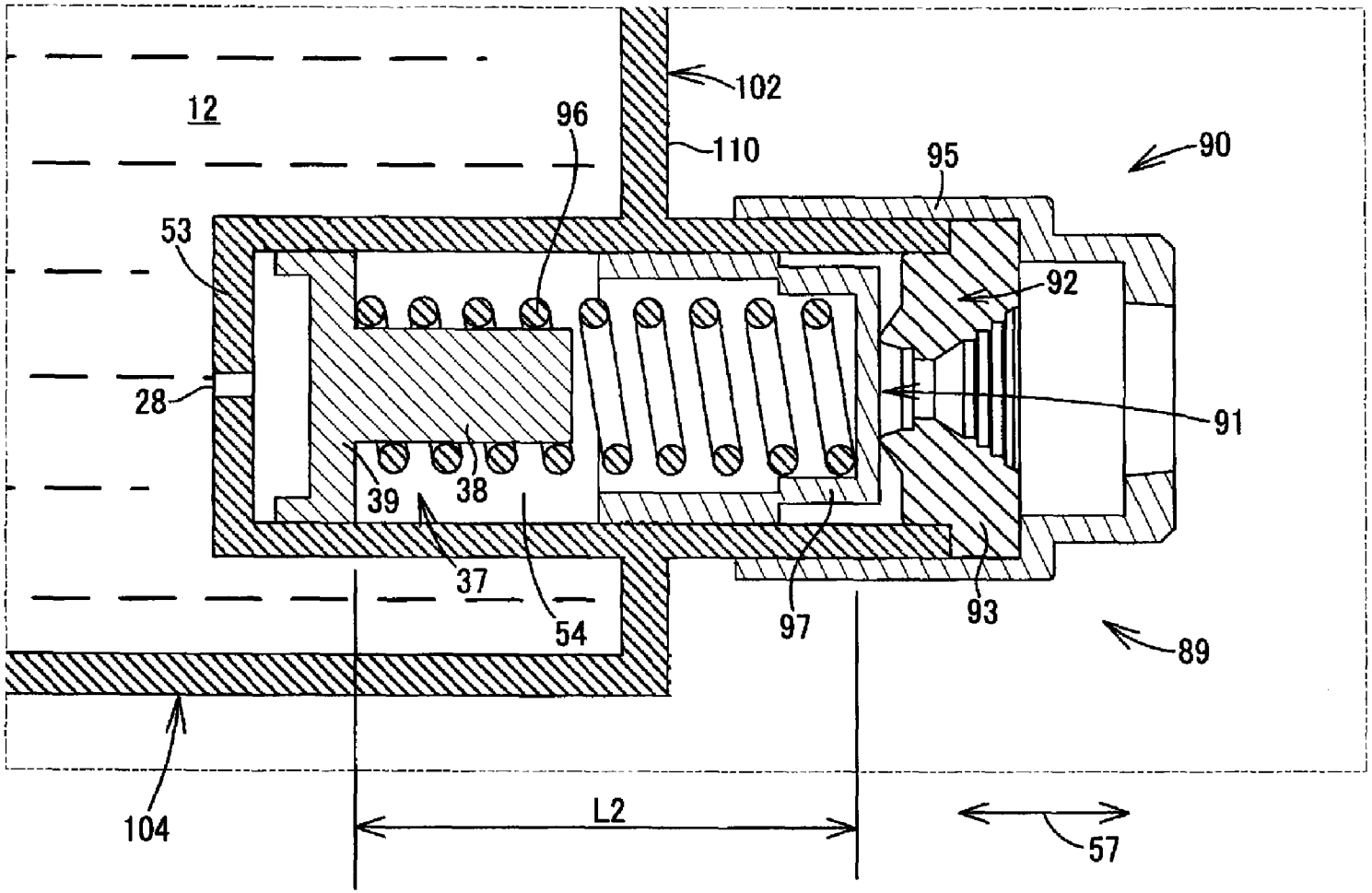
FIG. 4 is an enlarged cross-sectional view of an ink supply portion according to an embodiment of the invention.

Referring to FIG. 4, ink cartridge 10 may comprise an ink supply portion 89 positioned at front wall 102. Ink supply portion 89 may comprise a substantially circular, cylindrical wall extending from a portion of front wall 102 positioned adjacent to bottom wall 104, toward the exterior of case 20 in depth direction 57. A circular opening 92 may be formed at an end of the cylindrical wall of the ink supply portion 89. A valve chamber 54 may be formed in the cylindrical wall of ink supply portion 89, and valve chamber 54 may extend from opening 92 via the interior of the cylindrical wall of ink supply portion 89 to the interior of case 20 beyond front wall 102. Valve chamber 54 may extend in depth direction 57. Frame 110 may comprise an end wall 53 defining an end of valve chamber 54 opposite opening 92, and valve chamber 54 may be in fluid communication with ink chamber 12 via an opening 28 formed through end wall 53. Ink supply portion 89 also may comprise ink supply valve mechanism 90, and at least a portion of ink supply valve mechanism 90 may be accommodated in valve chamber 54.

Ink supply valve mechanism 90 may be configured to selectively allow and prevent fluid communication between the interior of ink chamber 12 and the exterior of case 20 via opening 92 and valve chamber 54. Ink supply valve mechanism 90 may comprise a second lid member 97 a compression coil spring 96, a sealing member 93, and a cap 95. Second lid member 97 may be positioned in valve chamber 54, and configured to slide in depth direction 57. Sealing member 93 may be positioned at the end of the cylindrical wall defining opening 92. Cap 95 may be attached to the outer peripheral portion of the cylindrical wall of ink supply portion 89, and sealing member 93 may be positioned therebetween. Cap 95 and sealing member 93 each may have openings formed therethrough, in depth direction 57. The openings of cap 95 and sealing member 93 may form an ink supply opening 91, and valve chamber 54 may be configured to be in fluid communication with the exterior of case 20 via ink supply opening 91.

Figure 5:
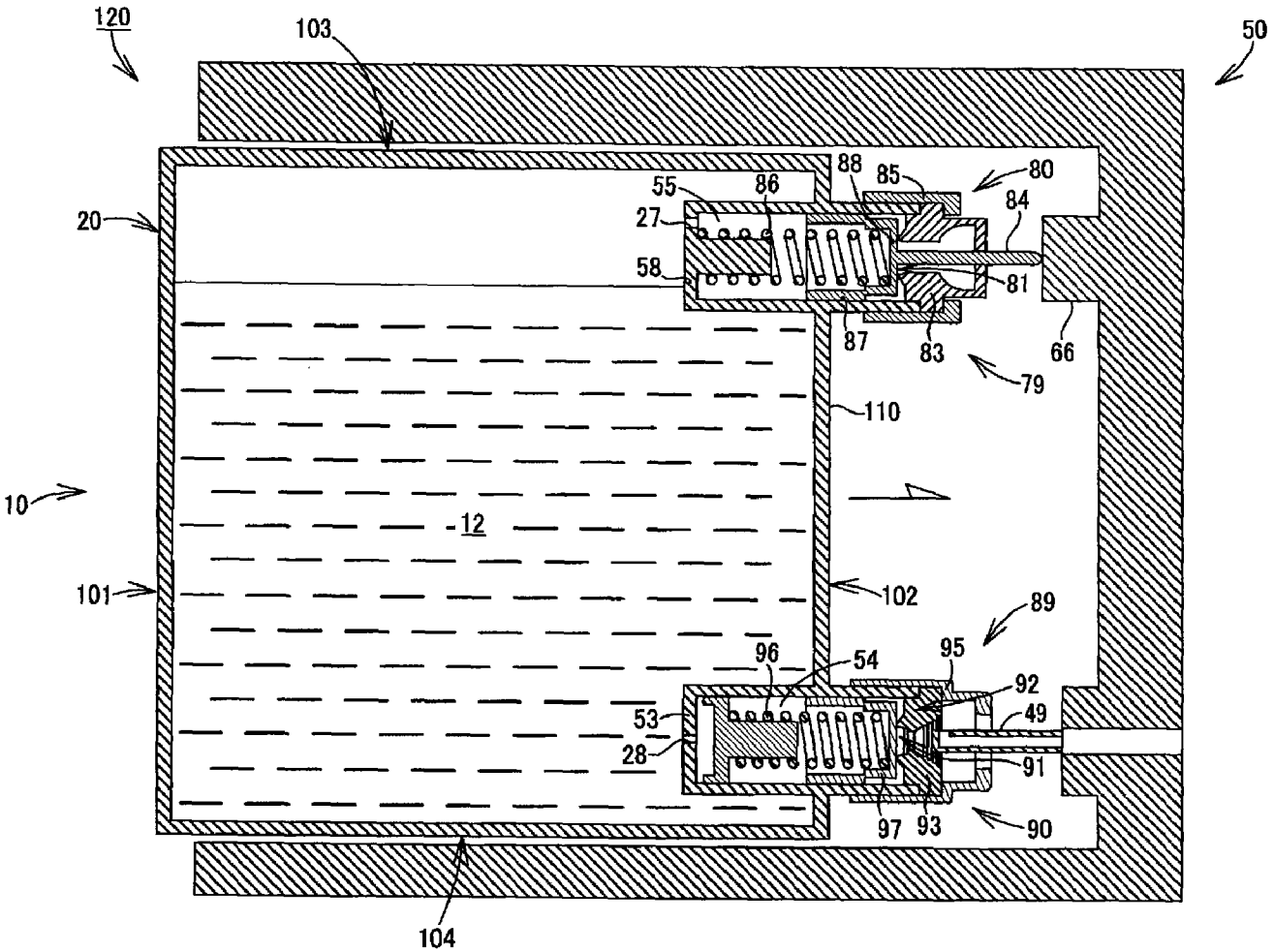
FIG. 5 is a cross-sectional view of the ink cartridge and the cartridge mounting portion of FIG. 2, during the mounting of the ink cartridge to the cartridge mounting portion, in which a rod of the air communication portion contacts a pressing portion of the cartridge mounting portion, and the ink introduction portion of the ink cartridge and a flexible ink tube are omitted.

Referring to FIG. 5, during the mounting of ink cartridge 10 to cartridge mounting portion 50, a rigid ink tube 49 may pass through ink supply opening 91. Ink tube 49 may comprise a rigid material and may have an opening formed therethrough at a position adjacent to the distal end thereof. The opening of ink tube 49 may extend from the interior of ink tube 49 to the peripheral outer surface of ink tube 49.

Referring to FIG. 4, when second lid member 97 slides in valve chamber 54 in depth direction 57, second lid member 97 may move between a third position, in which second lid member 97 is positioned away from, e.g., separated from, sealing member 93 and uncovers, e.g., does not cover, ink supply opening 91, and a fourth position in which second lid member 97 contacts sealing member 93 and covers ink supply opening 91. When second lid member 97 is in the fourth position, a path extending from valve chamber 54 via ink supply opening 91 to the exterior of case 20 may be blocked. When second lid member 97 is in the third position, the path may be opened.

Compression coil spring 96 may be positioned in valve chamber 54, and may be configured to expand and contract in depth direction 57. Compression coil spring 96 may be identical to compression coil spring 86, e.g., compression coil spring 96 may comprise the same material as compression coil spring 86 comprises, the diameter of the wire of compression coil spring 96 may be the same as that of compression coil spring 86, the number of loops, e.g., coils, of compression coil spring 96 may be the same as that of compression coil spring 86, the diameter of loops of compression coil spring 96 may be the same as that of compression coil spring 86, and the spring constant of compression coil spring 96 may be the same as that of compression coil spring 86.

Figure 7:
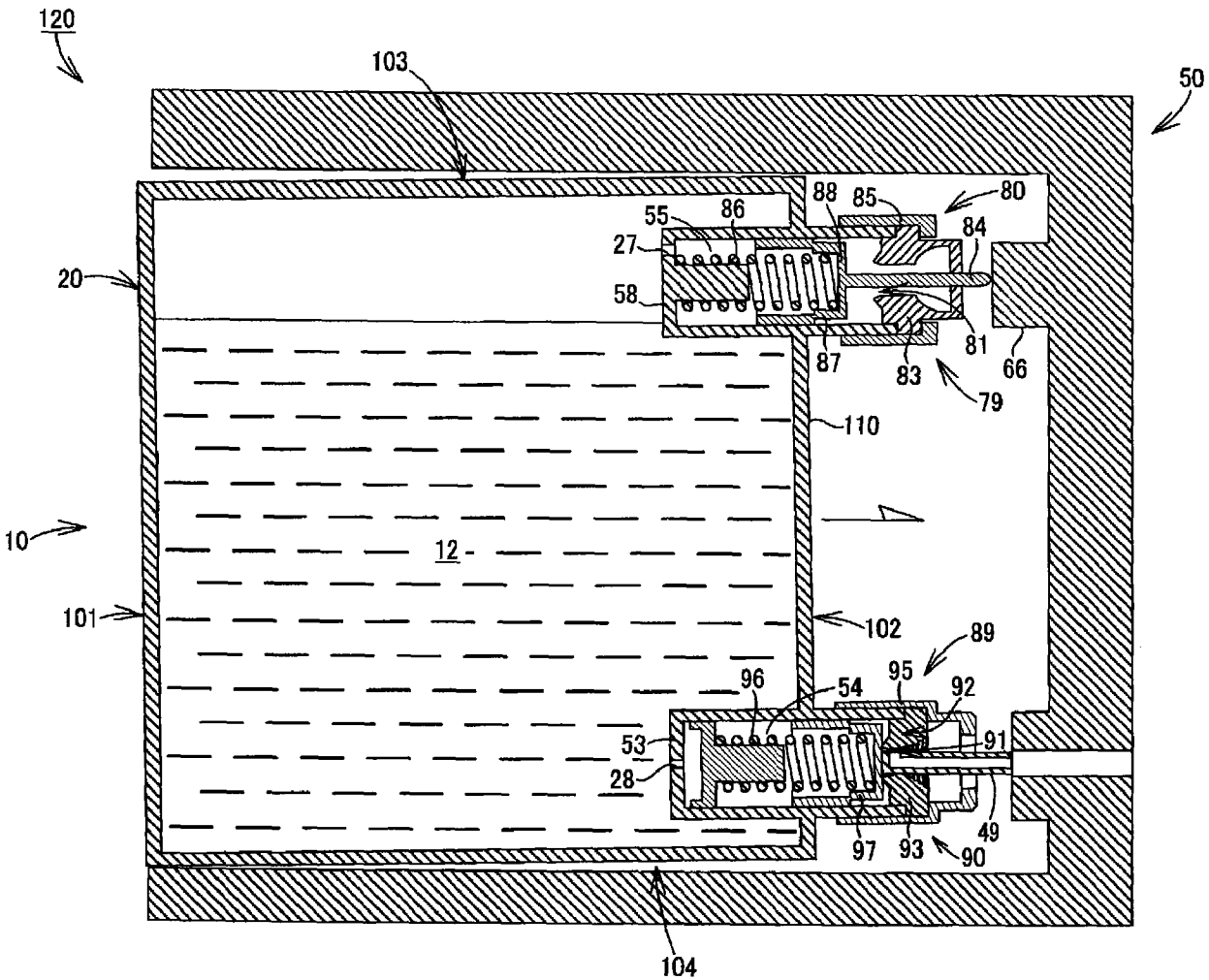
FIG. 7 is a cross-sectional view of the ink cartridge and the cartridge mounting portion of FIG. 2, during the mounting of the ink cartridge to the cartridge mounting portion, in which a rigid ink tube of the cartridge mounting portion contacts a second lid member of the ink supply portion, and the ink introduction portion of the ink cartridge and the flexible ink tube are omitted.
Figure 8:
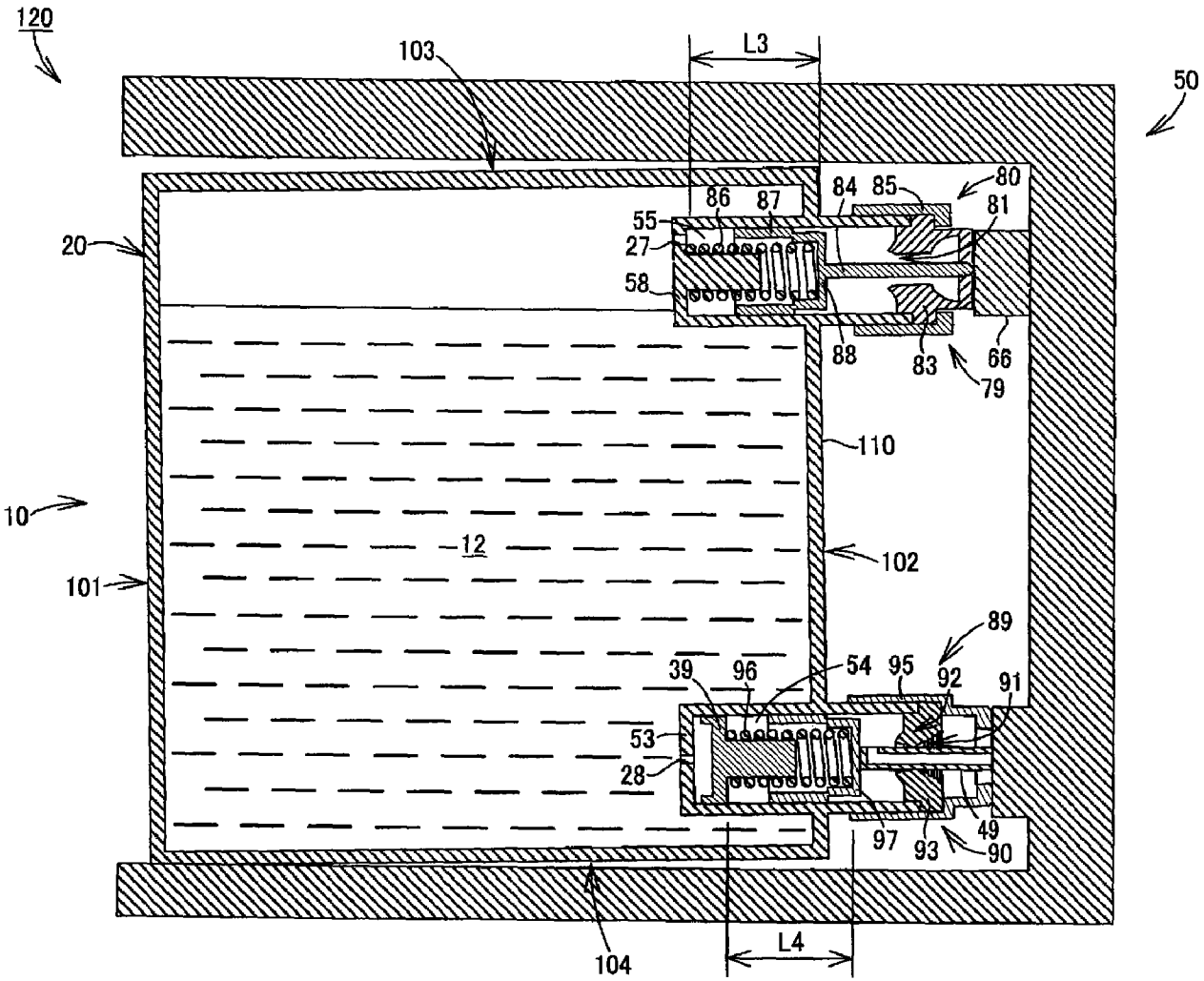
FIG. 8 is a cross-sectional view of the ink cartridge and the cartridge mounting portion of FIG. 2, in which the ink cartridge is mounted to the cartridge mounting portion completely, and the air communication opening of the air communication portion and an ink supply opening of the ink supply portion are uncovered, and the ink introduction portion of the ink cartridge and the flexible ink tube are omitted.

Compression coil spring 96 may contact and apply a biasing force to second lid member 97 toward ink supply opening 91 in depth direction 57. When no external force is applied to second lid member 97 in depth direction 57, second lid member 97 may be in the fourth position. Referring to FIGS. 7 and 8, during the mounting of ink cartridge 10 to cartridge mounting portion 50, ink tube 49 may be inserted into ink supply opening 91, and ink tube 49 may contact and apply a pressing force to second lid member 97 toward end wall 53. When second lid member 97 receives the pressing force from ink tube 49, second lid member 97 may move away from sealing member 93 against the biasing force of compression coil spring 96. The movement of second lid member 97 away from sealing member 93 may uncover ink supply opening 91, and ink may be supplied from ink chamber 12 to the recording head via valve chamber 54 and ink tube 49.

Referring to FIG. 4, spring receiving member 37 may be positioned in valve chamber 54 adjacent to end wall 53. Spring receiving portion 37 may comprise a rod 38 and a base portion 39. Rod 38 may have a substantially circular, cylindrical shape extending from the center of a circular surface of base portion 39 in depth direction 57. The outer diameter of rod 38 may be slightly less than the inner diameter of compression coil spring 96, and rod 38 may be inserted into compression coil spring 96. Accordingly, compression coil spring 96 may be supported by rod 38, such that compression coil spring 96 may expand and contract in the direction in which rod 38 extends, e.g., in depth direction 57. An end of compression coil spring 96 may contact the circular surface of base portion 39.

Base portion 39 may have a substantially circular, cylindrical shape, and may be fitted in valve chamber 54. An opening (not shown) may be formed through base portion 39, such that ink may pass therethrough. When ink in ink chamber 12 flows into valve chamber 54, the ink may flow through opening 28 and the opening of base portion 39.

Referring to FIG. 3, when no external force is applied to valve member 87 in depth direction 57, first lid member 88 may be in the second position in which first lid member 88 contacts sealing member 83 and covers air communication opening 81. Similarly, referring to FIG. 4, when no external force is applied to second lid member 97 in depth direction 57, second lid member 97 may be in the fourth position in which second lid member 97 contacts sealing member 93 and covers ink supply opening 91. A distance L1 between end wall 58 and first lid member 88 in depth direction 57 may be greater than a distance L2 between base portion 39 of spring receiving portion 37 and second lid member 97.

In an embodiment, compression coil spring 86 and compression coil spring 96 may be identical. In the embodiment in which compression coil spring 86 and compression coil spring 96 are identical, compression coil spring 96 may be compressed more than compression coil spring 86 is compressed when first lid member 88 is in the second position and second lid member 97 is in the fourth position. The distance between a first end of compression coil spring 96 and a second end of compression coil spring 96 opposite the first end in depth direction 57, may be less than the distance between a first end of compression coil spring 86 and a second end of compression coil spring 86 in depth direction 57, when first lid member 88 is in the second position and second lid member 97 is in the fourth position.

Because compression coil spring 86 and compression coil 96 may be substantially identical, and because the distance between the first end and the second end of compression coil spring 86 may be greater than the distance between the first end and the second end of compression coil spring 96, the biasing force of compression coil spring 86 may be less than the biasing force of compression coil spring 96 when the first lid member 88 is in the second position and second lid member 97 is in the fourth position.

Consequently, the ink leakage from ink supply opening 91 may be reduced or prevented when ink cartridge 10 is not mounted to cartridge mounting portion, and a force which a user receives from compression coil spring 86 may become relatively weaker and able to be overcome by the user during the mounting of ink cartridge 10 to cartridge mounting portion 50. In another embodiment, compression coil spring 86 and compression coil spring 96 may be replaced with an elastic member comprising resin.

Referring to FIG. 2, pressing portion 66 may be positioned at an upper portion of an end wall of cartridge mounting portion 50, at a position corresponding to a position of rod 84 of air communication valve mechanism 80. When ink cartridge 10 is inserted into cartridge mounting portion 50, the distal end of rod 84 may contact pressing portion 66. When ink cartridge 10 is further inserted into cartridge mounting portion 50, rod 84 may be pressed against pressing portion 66, and rod 84 may receive a pressing force from pressing portion 66 as a reaction force from the pressing force. When rod 84 receives the pressing force, rod 84 and first lid member 88 may move against the biasing force of compression coil spring 86, which may uncover air communication opening 81.

Rigid ink tube 49 may be positioned at a lower portion of the end wall of cartridge mounting portion 50, at a position corresponding to a position of ink supply valve mechanism 90 of ink cartridge 10. Ink tube 49 may be a hollow tube extending from the end wall of cartridge mounting portion 50 toward an opening of cartridge mounting portion 50, through which ink cartridge 10 is inserted into cartridge mounting portion 50. When ink cartridge 10 is inserted into cartridge mounting portion 50, ink tube 49 may be inserted into ink supply opening 91 and may contact second lid member 97. The outer diameter of ink tube 49 may be greater than ink supply opening 91, such that sealing member 93 elastically may deform and contact the outer peripheral surface of ink tube 49 fluid-tightly when ink tube 49 is inserted into ink supply opening 91, thereby providing a liquid-tight seal between sealing member 93 and ink tube 49.

When ink cartridge 10 is further inserted into cartridge mounting portion 50, second lid member 97 may be pressed against ink tube 49, and second lid member 97 may receive a pressing force from ink tube 49. When second lid member 97 receives the pressing force, second lid member 97 may move against the biasing force of compression coil spring 96. Accordingly, ink supply opening 91 may be uncovered, such that ink may be supplied from ink chamber 12 to the recording head via valve chamber 54 and ink tube 49.

FIGS. 2 and 5 to 8, describe a method of mounting ink cartridge 10 to cartridge mounting portion 50. Referring to FIG. 2, when ink cartridge 10 is not mounted to cartridge mounting portion 50, first lid member 88 may be in the second position, and second lid member 97 may be in the fourth position.

Figure 6:
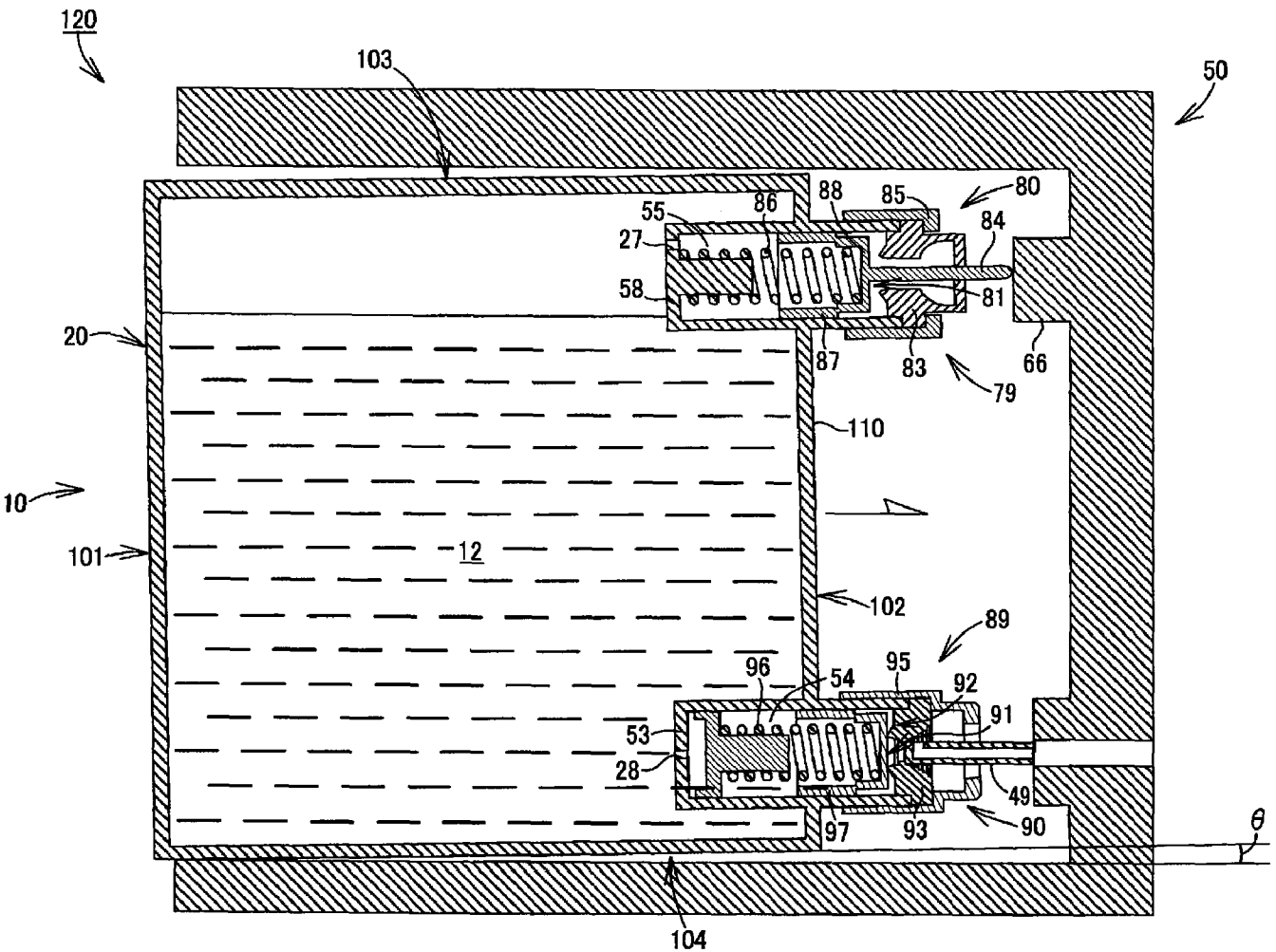
FIG. 6 is a cross-sectional view of the ink cartridge and the cartridge mounting portion of FIG. 2, during the mounting of the ink cartridge to the cartridge mounting portion, in which an air communication opening of the air communication portion is uncovered, and the ink introduction portion of the ink cartridge and the flexible ink tube are omitted.

Referring to FIG. 5, when ink cartridge 10 is inserted into cartridge mounting portion 50, the distal end of rod 84 may contact pressing portion 66. Referring to FIG. 6, when ink cartridge 10 is further inserted into cartridge mounting portion 50, rod 84 may be pressed against pressing portion 66, and first lid member 88 may move from the second position to the first position, against the biasing force of compression coil spring 86. At a time when first lid member is moving from the second position to the first position, ink tube 49 may not yet have contacted second lid member 97. Therefore, ink cartridge 10 may be inclined with respect to the horizontal direction by an angle θ, such that front wall 102 of case 20 may be lifted up obliquely with respect to the gravitational direction. Due to this alignment, first lid member 88 may start to move from the second position toward the first position before second lid member 97 starts to move from the fourth position toward the third position. The biasing force of compression coil spring 86 may increase when first lid member 88 moves from the second position to the first position.

Referring to FIG. 7, when ink cartridge 10 is further inserted into cartridge mounting portion 50, the distal end of ink tube 49 may contact second lid member 97. At a time when the distal end of ink tube 49 contacts second lid member 97, compression coil spring 86 already may have partially contracted. The contraction of compression coil 86 may be due to the initial contact of rod 84 with pressing portion 66, which may increase the biasing force of compression coil spring 86. Nevertheless, compression coil spring 96 may not yet have received a pressing force, and the biasing force of compression coil spring 96 may be unchanged prior to the contact between distal end of ink tube 49 and second lid member 97. Therefore, the biasing force of compression coil spring 86 may become greater than the biasing force of compression coil spring 96 at a time when the distal end of ink tube 49 contacts second lid member 97.

Referring to FIG. 8, when ink cartridge 10 is still further inserted into cartridge mounting portion 50, second lid member 97 may be pressed against ink tube 49, and second lid member 97 may move from the fourth position to the third position. When this occurs, compression coil spring 96 may contract, and the biasing force of compression coil spring 96 may increase. Because compression coil spring 86 also may contract when compression coil spring 96 contracts, the biasing force of compression coil spring 86 may remain greater than the biasing force of compression coil spring 96. Therefore, ink cartridge 10 may continue to be inclined with respect to the horizontal direction, e.g., by an angle θ, such that front wall 102 of case 20 may be obliquely lifted up with respect to the gravitational direction.

Referring to FIG. 8, when ink cartridge 10 is completely mounted to cartridge mounting portion 50, a distance between end wall 58 and first lid member 88 may be L3, and a distance between base portion 39 and second lid member 97 may be L4. As described above, during the mounting of ink cartridge 10 to cartridge mounting portion 50, first lid member 88 may start to move before second lid member 97 starts to move. The distance L1 minus L3, e.g., the distance which first lid member 88 may move during the mounting of ink cartridge 10 to cartridge mounting portion 50, may be greater than the distance L2 minus L4, e.g., the distance which second lid member 97 may move during the mounting of ink cartridge 10 to cartridge mounting portion 50.

Therefore, as descried above, a relationship between the biasing force of compression coil spring 86 and the biasing force of compression coil spring 96 may be reversed during the mounting of ink cartridge 10 to cartridge mounting portion 50. Accordingly, when ink cartridge 10 is not mounted to cartridge mounting portion 50, the biasing force of compression coil spring 86 may be less than the biasing force of compression coil spring 96, but when ink cartridge 10 is mounted to cartridge mounting portion 50, the biasing force of compression coil spring 86 may be greater than the biasing force of compression coil spring 96.

As described above, when ink cartridge 10 is mounted to cartridge mounting portion 50, the biasing force of compression coil spring 86 may be greater than the biasing force of compression coil spring 96. The difference between the biasing forces of compression coil spring 86 and compression coil spring 96 may cause ink cartridge 10 to be inclined with respect to the horizontal direction by an angle θ, such that front wall 102 of case 20 may be lifted up obliquely with respect to the gravitational direction. Ink supply opening 91 may be positioned higher relative to case 20, when compared to a position of an ink supply opening in the situation in which ink cartridge 10 is mounted to cartridge mounting portion 50 such that front wall 102 extends in the gravitational direction. Accordingly, leakage of ink from ink cartridge 10 may be reduced or prevented.

In an embodiment, compression coil spring 86 and compression coil spring 96 may be identical. Therefore, even when compression coil spring 86 and compression coil spring 96 are mixed up, e.g., interchanged, during the manufacture of ink cartridge 10, the biasing forces of compression coil spring 86 and compression coil spring 96 may not be different from predetermined biasing forces, and a mounting operation of ink cartridge 10 to cartridge mounting portion 50 may not be affected. Therefore, the assembly of ink cartridge 10 may become simplified.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. An ink cartridge comprising:

a case comprising:

an ink chamber configured to store ink therein; and a particular wall;

an air communication portion positioned at the particular wall and having a first opening formed therethrough, wherein the air communication portion is configured to place an interior of the ink chamber and an exterior of the ink chamber in fluid communication via the first opening, and the air communication portion comprises:

a first lid member configured to move between a first position and a second position, wherein when the first lid member is in the first position, the first lid member does not cover the first opening and when the first lid member is in the second position, the first lid member covers the first opening; and a first biasing member configured to apply a first biasing force to the first lid member toward the first opening;

an ink supply portion positioned at the particular wall and having a second opening formed therethrough, wherein the ink supply portion is configured to supply ink from the interior of the ink chamber to the exterior of the ink chamber via the second opening, and the ink supply portion comprises:

a second lid member configured to move between a third position and a fourth position, wherein when the second lid member is in the third position, the second lid member does not cover the second opening and when the second lid member is in the fourth position, the second lid member covers the second opening; and a second biasing member configured to apply a second biasing force to the second lid member toward the second opening, wherein when the first lid member is in the second position and the second lid member is in the fourth position, the first biasing force is less than the second biasing force.

2. The ink cartridge of claim 1, wherein the first biasing member comprises a first end and a second end opposite the first end, and the second biasing member comprises a first end and a second end opposite the first end, and wherein when the first lid member is in the second position and the second lid member is in the fourth position, a distance between the first end of the second biasing member and the second end of the second biasing member is less than a distance between the first end of the first biasing member and the second end of the first biasing member in a particular direction.

3. The ink cartridge of claim 2, wherein the first biasing member comprises a first compression spring and the second biasing member comprises a second compression spring, the first compression spring and the second compression spring are substantially identical, and each of the first compression spring and the second compression spring is configured to expand in the particular direction and contract in a direction opposite to the particular direction.

4. An ink supply system comprising:

a cartridge mounting portion; and an ink cartridge configured to be mounted to the cartridge mounting portion, wherein the ink cartridge comprises:

a case comprising:

an ink chamber configured to store ink therein; and a particular wall, an air communication portion positioned at the particular wall and having a first opening formed therethrough, wherein the air communication portion is configured to place an interior of the ink chamber and an exterior of the ink chamber in fluid communication via the first opening, and the air communication portion comprises:

a first lid member configured to move between a first position and a second position, wherein when the first lid member is in the first position, the first lid member does not cover the first opening and when the first lid member is in the second position, the first lid member covers the first opening; and a first biasing member configured to apply a first biasing force to the first lid member toward the first opening, an ink supply portion positioned at the particular wall and having a second opening formed therethrough, wherein the ink supply portion is configured to supply ink from the interior of the ink chamber to the exterior of the ink chamber via the second opening, and the ink supply portion comprises:

a second lid member configured to move between a third position and a fourth position, wherein when the second lid member is in the third position, the second lid member does not cover the second opening and when the second lid member is in the fourth position, the second lid member covers the second opening; and a second biasing member configured to apply a second biasing force to the second lid member toward the second opening, wherein when the ink cartridge is mounted to the cartridge mounting portion, the ink supply portion is positioned below the air communication portion, the first lid member is in the first position, the second lid member is in the third position, and the first biasing force is greater than the second biasing force.

5. The ink supply system of claim 4, wherein when the ink cartridge is separated from the cartridge mounting portion, the first biasing force is less than the second biasing force.

6. The ink supply system of claim 5, wherein during a mounting of the ink cartridge to the cartridge mounting portion, the air communication portion and the ink supply portion are configured such that the first lid member starts to move from the second position toward the first position before the second lid member starts to move from the fourth position toward the third position.

7. The ink supply system of claim 4, wherein the first biasing member comprises a first end and a second end opposite the first end, and the second biasing member comprises a first end and a second end opposite the first end, and when the first lid member is in the second position and the second lid member is in the fourth position, a distance between the first end of the second biasing member and the second end of the second biasing member is less than a distance between the first end of the first biasing member and the second end of the first biasing member in a particular direction.

8. The ink cartridge of claim 7, wherein the first biasing member comprises a first compression spring and the second biasing member comprises a second compression spring, and the first compression spring and the second compression spring are substantially identical, wherein each of the first compression spring and the second compression spring is configured to expand in the particular direction and contract in a direction opposite to the particular direction.

9. The ink supply system of claim 4, wherein the air communication portion comprises a rod extending from the first lid member through the first opening, and when the ink cartridge is mounted to the cartridge mounting portion, the rod is configured to press against the cartridge mounting portion.

10. The ink supply system of claim 4, wherein the cartridge mounting portion comprises:

a pressing portion configured to apply a first pressing force to the first lid member; and an ink tube configured to be inserted into the second opening and to apply a second pressing force to the second lid member, wherein during a mounting of the ink cartridge to the cartridge mounting portion, the first lid member is configured to receive the first pressing force, and to move from the second position to the first position, against the first biasing force, and the second lid member is configured to receive the second pressing force, and to move from the fourth position to the third position, against the second biasing force.

11. An ink supply system comprising:

a cartridge mounting portion; and an ink cartridge configured to be mounted to the cartridge mounting portion, wherein the ink cartridge comprises:

a case comprising:

an ink chamber configured to store ink therein; and a particular wall, an air communication portion positioned at the particular wall and having a first opening formed therethrough, wherein the air communication portion is configured to place an interior of the ink chamber and an exterior of the ink chamber in fluid communication via the first opening, and the air communication portion comprises:

a first lid member configured to move between a first position and a second position, wherein when the first lid member is in the first position, the first lid member does not cover the first opening and when the first lid member is in the second position, the first lid member covers the first opening;

a rod extending from the first lid member through the first opening; and a first biasing member comprising a first compression spring, the first compression spring comprising a first end and a second end opposite the first end, wherein the first biasing member is configured to expand in a particular direction and contract in a direction opposite to the particular direction, and to apply a first biasing force to the first lid member toward the first opening;

an ink supply portion positioned at the particular wall and having a second opening formed therethrough, wherein the ink supply portion is configured to supply ink from the interior of the ink chamber to the exterior of the ink chamber via the second opening, and the ink supply portion comprises:

a second lid member configured to move between a third position and a fourth position, wherein when the second lid member is in the third position, the second lid member does not cover the second opening and when the second lid member is in the fourth position, the second lid member covers the second opening; and a second biasing member comprising a second compression spring, the second biasing member comprising a first end and a second end opposite the first end, wherein the second biasing member is configured to expand in the particular direction and contract in the direction opposite to the particular direction, and to apply a second biasing force to the second lid member toward the second opening, wherein the first compression spring and the second compression spring are substantially identical, and wherein when the first lid member is in the second position and the second lid member is in the fourth position, a distance between the first end of the second biasing member and the second end of the second biasing member is less than a distance between the first end of the first biasing member and the second end of the first biasing member in the particular direction, wherein during a mounting of the ink cartridge to the cartridge mounting portion, the air communication portion and the ink supply portion are configured such that the first lid member starts to move from the second position toward the first position before the second lid member starts to move from the fourth position toward the third position, wherein the first lid member is configured to move from the second position to the first position by the rod being pressed against the cartridge mounting portion, and wherein when the ink cartridge is mounted to the cartridge mounting portion, the ink supply portion is positioned below the air communication portion, the first lid member is in the first position, the second lid member is in the third position, and the first biasing force is greater than the second biasing force.

12. The ink supply system of claim 11, wherein the cartridge mounting portion comprises:

a pressing portion configured to apply a first pressing force to the first lid member; and an ink tube configured to be inserted into the second opening and to apply a second pressing force to the second lid member, wherein during the mounting of the ink cartridge to the cartridge mounting portion, the first lid member is configured to move from the second position to the first position against the first biasing force while receiving the first pressing force, and the second lid member is configured to move from the fourth position to the third position against the second biasing force while receiving the second pressing force.

* * * * *